US007897859B2

(12) United States Patent
Ruttenberg

(10) Patent No.: US 7,897,859 B2
(45) Date of Patent: Mar. 1, 2011

(54) HINGED DRUMSTICK

(76) Inventor: Samuel Ruttenberg, Cherry Hill, NJ (US)

( * ) Notice: Subject to any disclaimer, the term of this patent is extended or adjusted under 35 U.S.C. 154(b) by 0 days.

(21) Appl. No.: 12/610,670

(22) Filed: Nov. 2, 2009

(65) Prior Publication Data

US 2010/0307317 A1 Dec. 9, 2010

Related U.S. Application Data

(60) Provisional application No. 61/184,467, filed on Jun. 5, 2009.

(51) Int. Cl.
*G10D 13/02* (2006.01)

(52) U.S. Cl. ..... 84/422.4

(58) Field of Classification Search ..... 84/422.4
See application file for complete search history.

(56) References Cited

U.S. PATENT DOCUMENTS 2,521,336 A * 9/1950 Bramson ..... 84/422.4
3,859,887 A * 1/1975 Buchanan ..... 84/422.4
3,866,508 A * 2/1975 Huslig ..... 84/422.4
3,893,364 A * 7/1975 Harrison ..... 84/422.4
5,370,030 A 12/1994 Horne
5,503,056 A * 4/1996 Evans ..... 84/422.4
6,271,451 B1 * 8/2001 Gress ..... 84/422.4
6,365,813 B1 * 4/2002 Gress ..... 84/422.4
6,924,423 B2 8/2005 O'Donnell
7,173,176 B2 2/2007 Nybye
7,375,271 B1 * 5/2008 Zelinsky ..... 84/422.4
7,435,889 B1 10/2008 Heidt
7,473,836 B2 1/2009 Barke
2010/0307317 A1 * 12/2010 Ruttenberg ..... 84/422.4
2010/0307318 A1 * 12/2010 Ruttenberg ..... 84/422.4

* cited by examiner

*Primary Examiner* — Jeffrey Donels
*Assistant Examiner* — Robert W Horn
(74) *Attorney, Agent, or Firm* — Kaplan Gilman & Pergament LLP

(57) ABSTRACT

A percussion instrument is disclosed that may include a body having a longitudinal axis extending from a butt end to a striking end thereof and at least one hole extending along a transverse axis through the thickness of the body; a grasping mechanism having a first grip plate at a first end thereof and a second grip plate at a second end thereof, and a shaft extending through the hole in the body; and a compliance mechanism disposed between the first and second grip plates, enabling the first and second grip plates to be brought closer together in response to a compressive force applied to the grasping mechanism.

15 Claims, 6 Drawing Sheets

HINGED DRUMSTICK

CROSS-REFERENCE TO RELATED APPLICATIONS

This application claims the benefit of U.S. Provisional Patent Application Ser. No. 61/184,467, filed Jun. 5, 2009, entitled "Ruttenberg's Hinge Drumstick", the entire disclosure of which is incorporated by reference herein.

BACKGROUND OF THE INVENTION

This invention relates in general to musical percussion instruments, and more particularly to drumsticks for playing percussion instruments.

Drumsticks typically include a butt end, a striking end, and an intermediate region located in between the butt end and the striking end along the length of the body of the drumstick. The intermediate region generally includes a balance point about which the drumstick pivots when the tip or striking point of the drumstick rebounds from contact with a drum skin.

The drumstick is generally held at or near the balance point during use, since gripping the stick at this point generally minimizes the damping of the stick's movement as it strikes and then rebounds from the surface (i.e. skin) of a drum or other percussion device. In order to properly train students learning to play percussion instruments, such as, for instance, a snare drum, it is helpful not only to aid the student in grasping the stick at the balance point, but to encourage gripping of the stick in the proper manner. The latter is of particular importance in learning a technique in which the stick is effectively hinged between the thumb and forefinger of the user's hand, and the last three fingers of the hand controlling the rate of movement of the stick about the hinge formed by the thumb and forefinger.

Drumsticks have been devised which attempt to minimize damping or restraint on the motion of the drumstick, for example, by isolating of the body of the drumstick from the fingers with some resilient material which can be gripped with firmness and which will not completely inhibit free motion of the drumstick. Another approach has been to provide some form of locator at the balance point. However, such designs do not establish freedom from restraint in pivotal movement as the stick rebounds from the drum. Moreover, they do not facilitate grasping and control of the drumstick at the balance point, especially for the student learning the fingertip control method of playing drums.

Thus, it is a problem in the art that prior approaches to providing unrestrained pivotal motion of the drumstick do not also enable a user to exercise sufficient control over the drumstick.

SUMMARY OF THE INVENTION

According to one aspect, the present invention is directed to a percussion instrument that may include a body having a longitudinal axis extending from a butt end to a striking end thereof and at least one hole extending along a transverse axis through the thickness of the body; a grasping mechanism having a first grip plate at a first end thereof and a second grip plate at a second end thereof, and a shaft extending through the hole in the body; and a compliance mechanism disposed between the first and second grip plates, enabling the first and second grip plates to be brought closer together in response to a compressive force applied to the grasping mechanism.

Other aspects, features, advantages, etc. will become apparent to one skilled in the art when the description of the preferred embodiments of the invention herein is taken in conjunction with the accompanying drawings.

Figure 1:
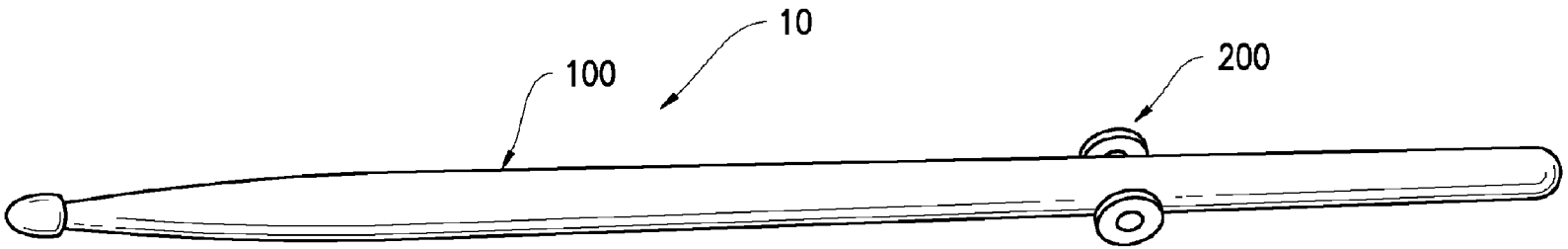
FIG. 1 is a perspective view of a drumstick in accordance with an embodiment of the present invention.

For the purposes of illustrating the various aspects of the invention, there are shown in the drawings forms that are presently preferred, it being understood, however, that the invention is not limited to the precise arrangements and instrumentalities shown.

DETAILED DESCRIPTION OF THE PREFERRED EMBODIMENTS

In the following description, for purposes of explanation, specific numbers, materials and configurations are set forth in order to provide a thorough understanding of the invention. It will be apparent, however, to one having ordinary skill in the art that the invention may be practiced without these specific details. In some instances, well-known features may be omitted or simplified so as not to obscure the present invention. Furthermore, reference in the specification to phrases such as "one embodiment" or "an embodiment" means that a particular feature, structure or characteristic described in connection with the embodiment is included in at least one embodiment of the invention. The appearances of phrases such as "in one embodiment" or "in an embodiment" in various places in the specification do not necessarily all refer to the same embodiment.

FIG. 1 is a perspective view of a drumstick 10 in accordance with an embodiment of the present invention. The drumstick 10 of FIG. 1 may include body 100 and hinge 200. These features will be discussed in greater detail in connection with FIG. 2.

Figure 2:
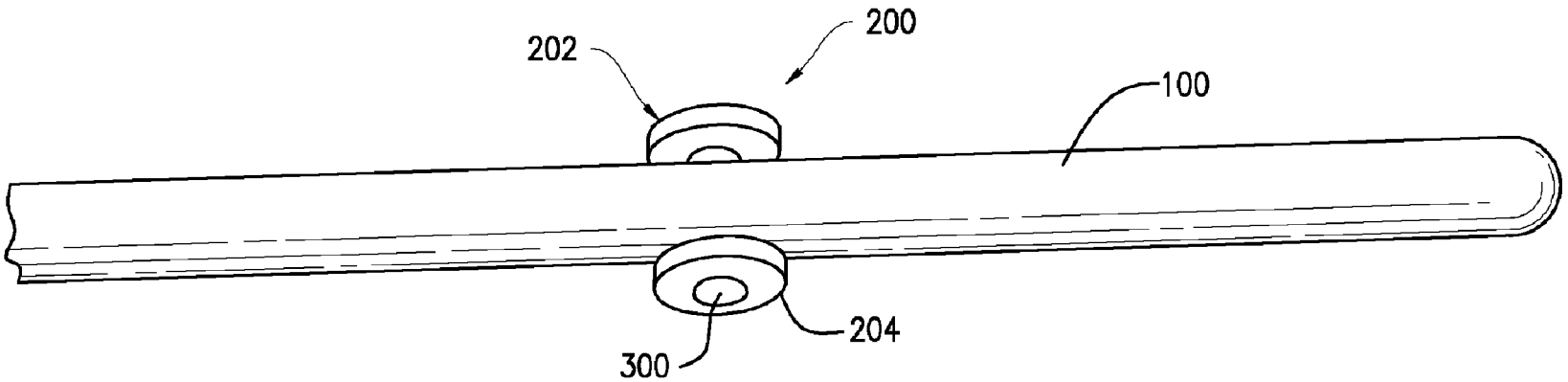
FIG. 2 is a perspective view of a portion of a drumstick in accordance with an embodiment of the present invention.

FIG. 2 shows body 100 and hinge 200 which may include hinge elements 202 and 204, and fastener 300. Fastener 300 may simply be a pin that is attachable to the hinge elements 202 and 204. Alternatively, fastener 300 may have a more complex geometry and a plurality of parts as discussed later herein.

Figure 3:
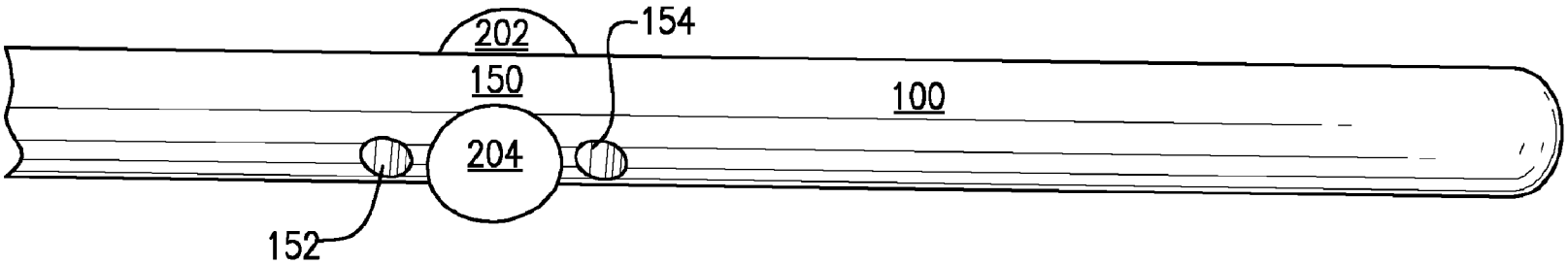
FIG. 3 is a perspective view of a portion of a drumstick in accordance with another embodiment of the present invention.

FIG. 3 is a perspective view of a portion of body 100 of drumstick 10. Body 100 may include holes 150, 152, and 154 and may be coupled to hinge elements 202 and 204. The location of hole 150 can only be shown indirectly as the nearest opening of hole 150 (in the view of FIG. 3) is obscured by hinge element 204. The distribution of holes 150, 152, and 154 preferably enables a user of drumstick 10 to select the most desirable pivot point along the length of body 100 at which to install hinge elements 202 and 204 forming fastener 300. Preferably, hinge elements 202 and 204 may be readily disconnected from one another, for example by unscrewing a threaded connection, and re-connected within a preferred hole among holes 150, 152, and 154.

Figure 4:
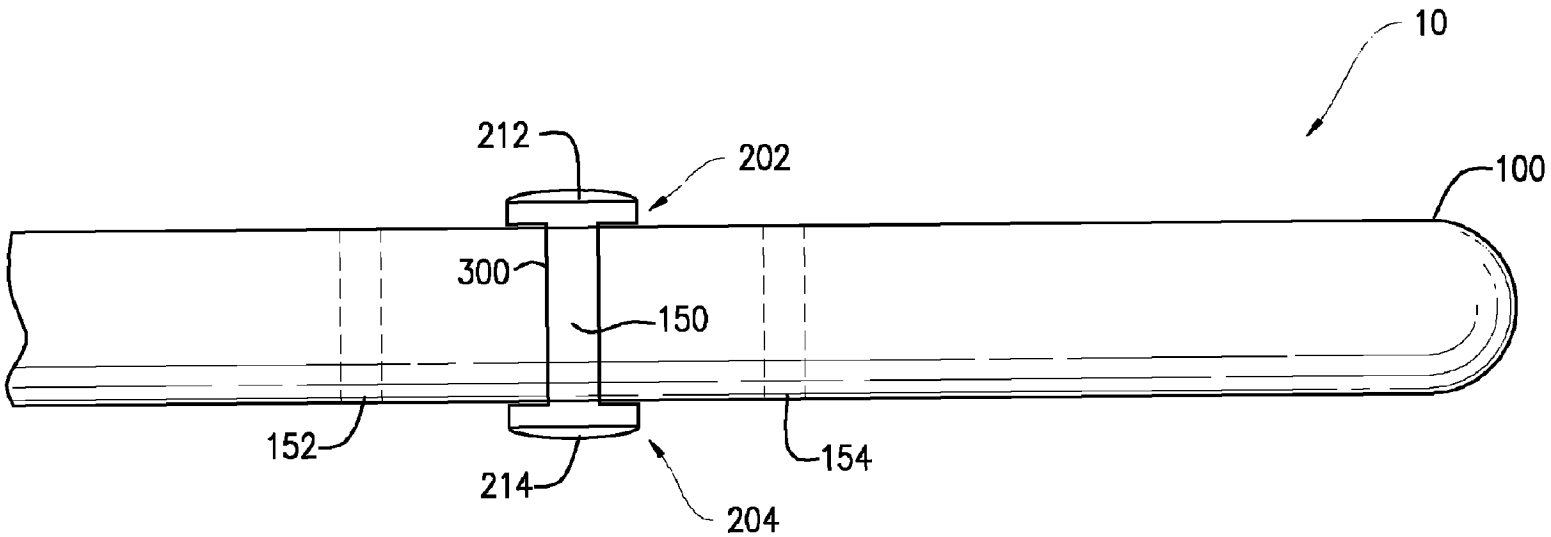
FIG. 4 is a sectional view of a drumstick in accordance of an embodiment of the present invention.

FIG. 4 is a sectional view of drumstick 10 in accordance of an embodiment of the present invention. FIG. 4 shows body 100 having holes 150, 152, and 154; fastener 300 inserted through hole 150; and hinge elements 202 and 204 having pads 212 and 214, respectively. Pads may be attached to their respective hinge elements to provide more desirable contact characteristics for a user of the drumstick 10. Alternatively, grip pads 212, 214 may be omitted, and each hinge element 202, 204 could be formed using a single integral part.

Figure 5:
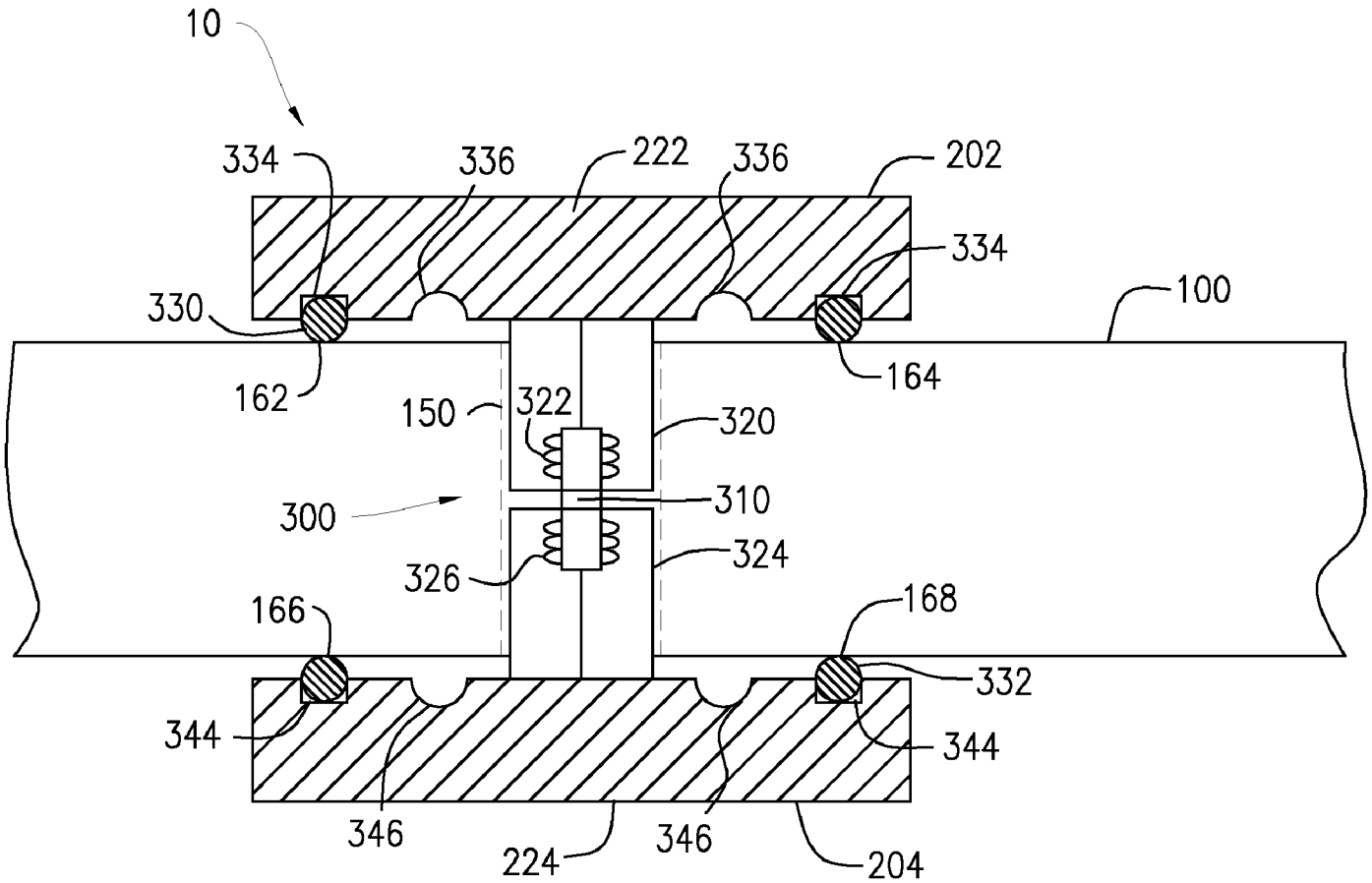
FIG. 5 is a more detailed sectional view of the drumstick of FIG. 4 in accordance with an embodiment of the present invention.

In this embodiment, hinge elements 202 and 204 may be readily disconnected from one another and then re-attached within a different one of three available holes 150, 152, 154. This disconnection and reconnection of hinge elements 202 and 204 may be achieved by unscrewing one of the threaded connections securing hinge elements 202, 204 together (see FIG. 5), and then re-connecting the two parts together in a different hole, selected from holes 150, 152, and 154. While a threaded connection is shown in FIG. 5, the present invention is not limited to this connection means. Other means of connecting two rods together may be practiced, such as a press fit, friction fit, etc. Moreover, while three holes are shown in FIGS. 3-4, it will be appreciated that in alternative embodiments, body 100 may include fewer or more than three holes.

FIG. 5 is a more detailed schematic sectional view of the percussion instrument 10 of FIG. 4 in accordance with an embodiment of the present invention. Percussion instrument 10 is preferably a drumstick but is not limited to this embodiment. Percussion instrument 10 may be any one of a number of other possible percussion instruments, including for instance, a Timpani stick.

Drumstick 10 of FIG. 5 may include body 100 and hinge 200. Hinge 200 may include hinge elements 202 and 204, set screw 310, and/or O-rings 330 and 332. Body 100 may be a conventional drumstick body that is preferably made of wood, though other materials may be employed. Body 100 may include flat portions 162, 162, 166, and 168 that are machined on a portion of body 100 that contacts O-rings 330 and 332 to maximize the surface area of contact between body 100 and the O-rings 330 and 332.

Hinge element 202 may include disk portion 222, shaft 320, open radius area (deflection recess) 336 for flexing hinge element 202 upon the application of force thereto, and groove 334 for housing O-ring 330. Similarly, hinge element 204 may include disk portion 224, shaft 326, deflection recess 346, and groove 344 for housing O-ring 332.

Fastener 300 may include shafts 320 and 324 of hinge elements 202 and 204 respectively. Fastener 300 may further include set screw 310 that may be disposed between shafts 320 and 324. Shafts 320 and 324 may include threaded regions 322 and 326, respectively, for engaging suitable portions of set screw 310. In other embodiments, shafts 320 and 324 may be configured to be capable of being directly screwed together without any need for an intervening set screw. Moreover, other mechanical attachment means may be provided for coupling shaft 320 of hinge element 202 and shaft 324 of hinge element 204.

Herein, the term "grasping mechanism" may refer to one or more parts included within hinge 200. The disk portions 222, 224 of hinge elements 202 and 204, respectively, may be referred to herein as grip plates. It will be appreciated that grip plates 222, 224 may, but need not be, disk shaped.

Hinge elements 202, 204 may be made of any desired material such as but not limited to wood, plastic, metal, polytetrafluoroethylene, or any combination of the foregoing. Shafts 320 324 may be made of the same materials as disk portions 222 and 224, or alternatively may be made of metal to strengthen the threaded connection with set screw 310. Set screw 310 is preferably made of metal, such as steel or aluminum. Alternatively, set screw 310 could be made of any other desirable material such as any of various plastics. O-rings 332 and 334 are preferably made of a suitably selected rubber. However, other materials may be used for O-rings 332, 334 if desired, such as, but not limited to plastic. Disk portions 222, 224 may be made of plastic, metal, or any other suitable material. While illustrated as disk-shaped, disk portions 222, 224 are not limited to having a disk-shaped geometry.

O-rings 330, 332 are disclosed herein as a mechanism for providing a "braking" function for the relative motion between body 100 and hinge elements 202 and 204. However, the present invention is not limited to the use of O-rings for this purpose, and other braking materials, which may be compressible materials, may be employed. Braking materials however are not limited to being compressible materials. Any material suitable for creating effective braking friction when brought into contact with the body 100 of drumstick 10 may be employed including but not limited to rubber, leather, one or more plastics of various types, wood, and/or metal. In other alternative embodiments, a combination of one or more of the foregoing materials may be employed.

In this section, the attachment means among the various parts are discussed. The disk portion 222 and shaft portion 320 of hinge element 202 may be two separate parts that are joined together. Alternatively, they form a single integral part. In one embodiment, portions 202 and 320 of hinge element 202 may be rotationally fixed with respect to one another. In other embodiments, shaft 320 may be capable of rotating freely with respect to disk portion 222. Arrangements analogous to the above may be applied to the connection between disk portion 224 and shaft portion 324 of hinge element 204.

Hinge elements 202 and 204 may be joined together by first attaching set screw 310 to the threaded portion 322 of shaft 320 of hinge element 202, and inserting the shaft portion 320 of hinge element 202 into hole 150 within body 100. Thereafter, the threaded portion 326 of shaft 324 of hinge element 324 may be threaded onto the free end of set screw 310. Once attached onto their respective ends of set screw 310, hinge elements 202 and 204 may be turned with respect to one another to secure a final attachment between the two parts. In another approach, the above process may be repeated in reverse, with the set screw 310 being first attached to hinge element 204, and hinge element 202 being threaded onto the assembly of set screw 310 and hinge element 204 within the interior of hole 150 of body 100.

Having described the individual parts, the materials the parts may be made of, and the interconnections between the parts, it remains to describe the operation of a preferred embodiment of the drumstick 10 of FIG. 5. Once fully assembled, and with no external force applied to force hinge elements 202 and 204 together, the body 100 of drumstick 10 is preferably pivotally mobile with respect to fastener 300 without any hindrance. A user may pick up drumstick 10 and hold it using disk portions (grip plates) 222 and 224 of hinge elements 202 and 204, respectively.

The user preferably initially holds the grip plates 222, 224 so as to apply force substantially at the center of the grip plates 222, 224 and thereby avoid deflecting the periphery of plates 222, 224 toward the o-rings 330, 332. In this manner, using the initial grasping position, body 100 is preferably freely pivotally mobile with respect to fastener 300, thereby enabling the desirable free rotational motion of body 100 for both learning and performing purposes.

Another benefit of using O-rings 330 and 332 is to prevent an undesirable clicking sound upon the impact of the striking end of drumstick 10, or other type of percussion instrument, with a drum skin, or other percussion surface. The possibility of a clicking sound upon impact of the drumstick with a drum skin arises from the presence of the apparatus of hinge 200 within and near body 100. An impact between body 100 and any portion of hinge 200 may produce the undesired clicking sound. The placement of O-rings 330 and 332 in the locations shown in FIG. 5 preferably operates to massively reduce and/or eliminate the undesired clicking sound by cushioning any undesired impact between hinge elements 202, 204 and body 100. It is noted that devices other than O-rings 330 and 332 may be employed to prevent the undesired impact between parts of hinge 200 and body 100.

When a user of drumstick 10 wishes to limit the rotational speed and/or the angular displacement of body 100 with respect to fastener 300, the user may shift the location of the compressive holding force on grip plates 222, 224 so as to deflect the edges of grip plates 222 and 224 about deflection recesses 334 and 344 respectively, and in turn cause O-rings 330 and 332 to impinge on body 100 of drumstick 10, which thereby operates to hinder the rotational motion of body 100 with respect to fastener 300. In this manner, the rotational speed and/or the angular motion range of body 100 with respect to fastener 300 may be controlled as a function of the location and magnitude of the compressive force applied by the user to the respective grip plates 222, 224. Moreover, the extent and location of the applied force is under the control of the user of drumstick 10, thereby enabling the user to either allow unimpeded pivotal motion of drumstick 10 or to controllably dampen the motion of drumstick 10 in response to the compressive force applied by the user.

Figure 6:
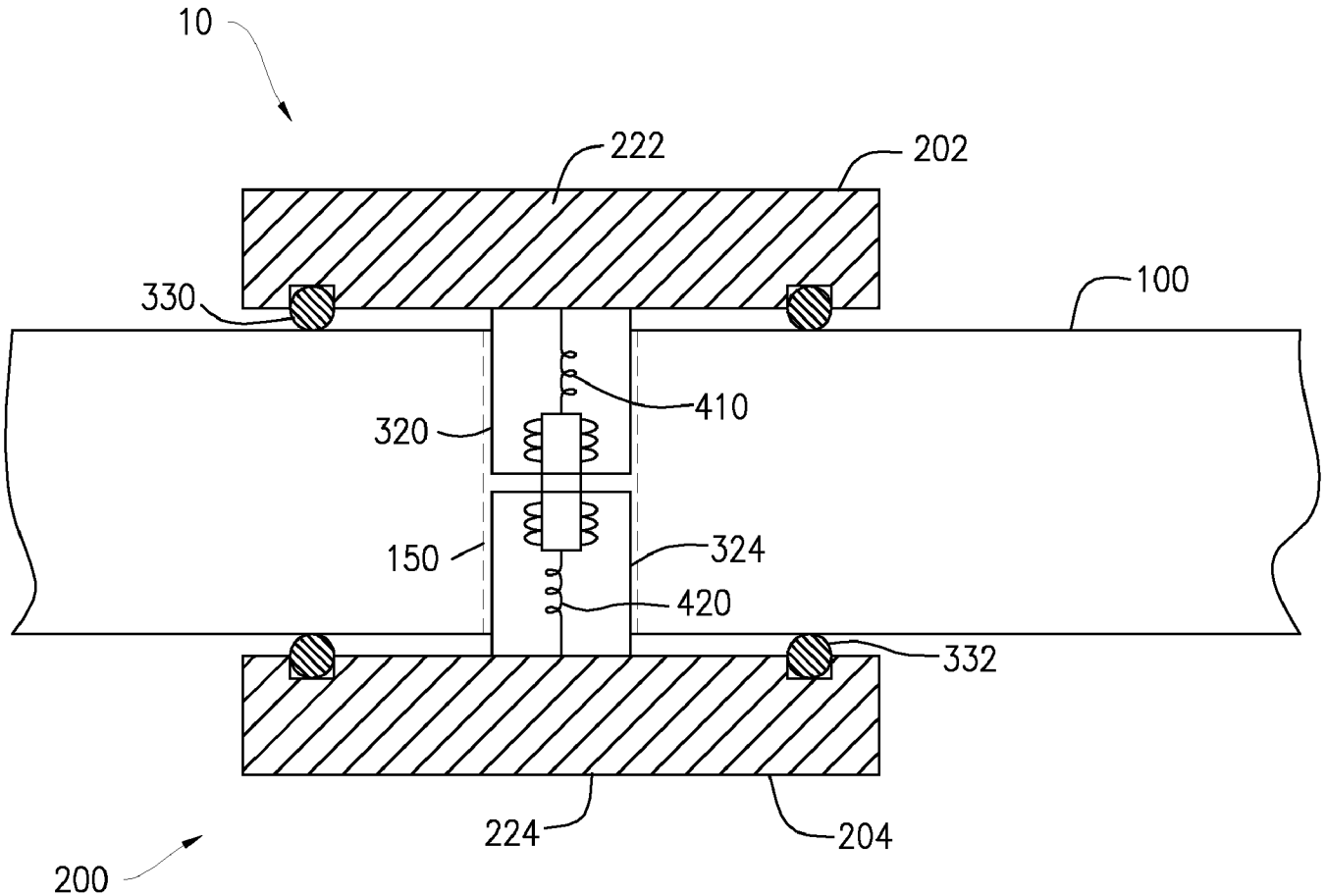
FIG. 6 is a schematic sectional view of a hinge coupled to a body of a drumstick in accordance with an embodiment of the present invention.

Another approach to enabling braking of the motion of body 100 with respect to hinge elements 202 and 204 is shown in FIG. 6. More specifically, an alternative approach to enabling the lateral (i.e. transverse-axis) compliance of hinge 200 in response to a compressive force so that O-rings 330 and 332 and can be moved toward body 100 to provide the desired braking function for the motion of body 100 with respect to hinge elements 202 and 204. Herein, the term "compliance device" may refer to the one or more springs 410, 420 of FIG. 6, or any other mechanism that is operable to enable disk portions 222 and 224 to move closer together in response to a compressive force applied thereto.

Accordingly, in FIG. 6, the deflection recesses 336, 346 may be omitted as shown. Instead, springs 410 and/or 420 may be employed to enable spring-loaded transverse-axis relative movement between disk portion 402 and disk portion 404. We turn now to the operation of the drumstick 10 of FIG. 6. When free motion of body 100 with respect to hinge 200 (including disk portions 202, 204) is desired, a user preferably holds disk portions 222, 224 with a compressive force sufficiently small so that O-rings 330, 332 do not impart any significant frictional braking force against body 100 of drumstick 10. When a user wishes to control the pivotal speed and/or extent of pivotal motion of body 100 with respect to disk portions 222, 224, the user may hold disk portions 222 and 224 with a compressive force sufficient to move these two parts towards one another and thereby bring O-rings 330, 332 into contact with body 100, thereby imparting a frictional braking force to body 100. Thereafter, the braking effect may adjusted by the user by adjusting the amount of compressive force used to hold disk portions 222 and 224. If desired, the compliance features of FIG. 5 and FIG. 6 could be combined within a single embodiment. Thus, one or both of springs 410, 420 could be included along with one or more of deflection recesses 336, 346.

While the above embodiments involves using O-rings 330, 332 as the entity making frictional contact with body 100, i.e. as the "braking material," the present invention is not limited to the use of O-rings. Other materials having other shapes may be employed either in addition to, or in place of, O-rings 330, 332. Other materials for the frictional contact device (i.e. the role of O-rings 330, 332 in FIG. 6) may include but are not limited to plastic, rubber, wood, fiberglass, metal, or any combination of the foregoing. In still other embodiments, the presence of a braking material separate from disk portions 222 and 224 could be omitted entirely. Where such separate braking material is omitted, friction between the internal surfaces of disk portions 202, 204 themselves and the body 100 could be used to brake and/or control the motion of body 100 with respect to the disk portions 222 and 224.

While two springs 410, 420 are shown in FIG. 6, it will be appreciated that three or more springs could be employed. Moreover, the invention may be practiced using only a single spring. Moreover, the one or more springs providing the needed compliance need not be located as springs 410 and 420 are shown in FIG. 6. Compliant devices, such as springs, could be located at any point that would allow disk portions 222 and 224 move closer together upon the application of compressive force between these two parts.

In one embodiment, a detent mechanism (not shown) could be employed along the structural path from disk portion 222 and 224 to establish a threshold force level below which disk portions 222 and 224 would not move closer together. At compressive force levels above the detent-mechanism compressive-force threshold, the compressive force would begin to force disk portions 222 and 224 together and initiate the braking function discussed above.

One or more embodiments of the present provide the benefits of enabling the player to visualize and feel the rebound; enabling the player to visualize and feel how a loose grip can benefit playing; enabling the player to work on velocity strokes, facilitating the whipping motion of the Moeller Technique; promoting finger technique for the Timpani technique; forcing the player to hold the stick in the correct manner by gripping the pads between the thumb and index finger; and/or allowing the player to have control of the stick by squeezing the pads for more technical playing such as for double strokes and buzz rolls.

In alternative embodiments, the following variations could be practiced to benefit various embodiments of the invention: (1) the use of different hole diameters; (2) the use of different hole locations; (3) the use of a different size or type of stick; (4) the use of a different drum stick tip (wood or nylon); (5) the use of a timpani stick; (6) a variation in the diameter of the portion of fastener 300 extending though hole 150; (7) the use of a different diameter (or shape) of the disk portions 222, 224 of the hinge elements 202, 204; and/or (8) the use of different means of securing together the shaft portions 320, 324 that engage one another within hole 150.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A percussion instrument comprising:

a body having a longitudinal axis extending from a butt end to a striking end thereof and at least one hole extending along a transverse axis of the body through the thickness thereof;

a grasping mechanism having a first grip plate at a first end thereof and a second grip plate at a second end thereof, and a shaft extending from the first grip plate through the hole in the body to the second grip plate; and a compliance mechanism disposed between the first and second grip plates, enabling the first and second grip plates to be moved closer together in response to a compressive force applied to the grasping mechanism.

2. The percussion instrument of claim 1 further comprising:

a braking material disposed between the body and inside surfaces of the grip plates.

3. The percussion instrument of claim 1 wherein the shaft is operable to enable pivotal motion of the body with respect to the grasping mechanism.

4. The percussion instrument of claim 2 wherein the braking material is operable to inhibit motion of the body with respect to the grip plates upon an application of compressive force to the grip plates.

5. The percussion instrument of claim 2 wherein the braking material comprises at least one compressible material.

6. The percussion instrument of claim 2 wherein the braking material comprises at least one O-ring.

7. The percussion instrument of claim 4 wherein flat portions are located on surfaces of the body that contact the braking material.

8. The percussion instrument of claim 6 wherein the compressible material comprises a first o-ring disposed between an exterior of the body and an inner surface of the first grip plate, and a second o-ring disposed between an exterior of the body and the an inner surface of the second grip plate.

9. The percussion instrument of claim 2 wherein at least one said grip plate includes a recess on an inside surface thereof.

10. The percussion instrument of claim 9 wherein the recess enables an application of an external compressive force to deflect an outer edge of the grip plate toward the braking material and to in turn cause the braking material to contact the body and inhibit relative motion of the body with respect to the grasping mechanism.

11. The percussion instrument of claim 9 wherein both said first and second grip plates include respective recesses on respective inside surfaces thereof.

12. The percussion instrument of claim 1 wherein the body comprises:

three holes extending through a transverse axis of the body.

13. The percussion instrument of claim 12 wherein the grasping mechanism comprises:

a threaded connection enabling disconnection of the first grip plate from the second grip plate.

14. The percussion instrument of claim 13 wherein the threaded connection further enables re-connection of the grip plates to one another through any selected one of the three holes.

15. The percussion instrument of claim 1 wherein the compliance mechanism comprises:

at least one spring.

* * * * *